United States Patent [19]

Dudzik

[11] Patent Number: 4,601,406

[45] Date of Patent: Jul. 22, 1986

[54] INJECTION MOLDED CONTAINER

[75] Inventor: Henryk Dudzik, Mansfield, United Kingdom

[73] Assignee: Mardon Illingworth Ltd, Nottinghamshire, United Kingdom

[21] Appl. No.: 747,981

[22] Filed: Jun. 24, 1985

[51] Int. Cl.[4] ..... B65D 1/46; B65D 25/32

[52] U.S. Cl. ..... 220/66; 220/72; 220/91; 220/96; 220/354

[58] Field of Search ..... 220/91, 95, 96, 94 R, 220/306, 354, 355, 72, 66

[56] References Cited

U.S. PATENT DOCUMENTS

| | | | |
|---|---|---|---|
| 581,483 | 4/1897 | MacDonald | 220/91 |
| 1,679,657 | 8/1928 | Glancy | 220/91 |
| 3,185,342 | 5/1965 | Gottsegen et al. | 220/91 |
| 3,448,893 | 6/1969 | Jeanneau | 220/91 |
| 3,627,170 | 12/1971 | Pulliam et al. | 220/306 |
| 3,924,775 | 12/1975 | Andreaggi et al. | 220/96 |
| 4,071,939 | 2/1978 | Bock | 220/91 X |
| 4,225,045 | 9/1980 | Rayner et al. | 220/91 X |

FOREIGN PATENT DOCUMENTS

| | | |
|---|---|---|
| 1024870 | 2/1958 | Fed. Rep. of Germany . |
| 2026198 | 12/1971 | Fed. Rep. of Germany . |
| 3119167 | 2/1982 | Fed. Rep. of Germany . |
| 1327231 | 4/1963 | France . |
| 87825 | 10/1966 | France . |
| 7411108 | 1/1977 | France . |
| 2382377 | 9/1978 | France . |
| 2463063 | 2/1981 | France . |
| 2494179 | 5/1982 | France . |

*Primary Examiner*—Allan N. Shoap

[57] ABSTRACT

The container comprises a body, which is a one-piece injection moulding, having a cylindrical wall (12) with a smooth exterior without projections, a mouth (13) and a rim (14). At diametrically opposite positions on the cylindrical wall is provided an inwardly projecting boss (20) having no projection to the exterior. Each boss has a recess (21) open to the exterior and receiving in snap-engagement a spigot (32) on one end of a carrying handle (30) of yoke form. The spigot has annular bearing ribs (33, 34) journalled in the recess and has a locating blip (35) for engaging a depression (23) for releasably locating the handle relative to the body.

7 Claims, 4 Drawing Figures

INJECTION MOLDED CONTAINER

This invention relates to injection moulded containers.

Paint and similar materials are usually sold in metal containers of the type having a body, a cylindrical side wall and a mouth at the top defined by a radially inwardly projecting rim. This rim defines a drip channel and tightly receives a plug-fitting lid. A carrying handle is mounted in yoke fashion on the side wall with opposite end parts of the handle pivotally mounted on external projections on the side wall. The external surface of the side wall is directly printed.

Printing is carried out on a blank of sheet metal prior to forming of the side wall of the container from the sheet. A pair of projections is rivetted to the side wall after printing and each projection extends to the exterior of the side wall with a formation for receiving a respective end part of the handle.

It has become desirable for containers of this type to be manufactured by injection moulding without losing the character of the metal container. Such a container has to be printed on a cylindrical side wall and it is important that the exterior surface of the side wall is smooth to facilitate printing. Any projections on the exterior surface of the side wall would interfere with the printing process or make this difficult to carry out. This has been avoided by welding projecting formations onto the surface after printing and then pivotally attaching the handle to the formations.

This has the disadvantages that two welding steps have to be carried out on each container and the resultant weld is liable to break, so that, after filling the container, there are a number of rejects.

The present invention is concerned with eliminating the welding step and providing a more reliable connection of the handle to the container body, without making the printing process more difficult to carry out.

The present invention is characterised in that, prior to fitting of the handle, the circumferential external surface of the side wall is smooth without any projections, a pair of diametrically opposite internal projections extend radially inwardly from the inner surface of the side wall, each projection having a recess open to the exterior of the body, each end part of the handle having a spigot which pivotally seats in the corresponding one of the recesses, and retaining means retaining each spigot in the recess.

French Certificat d'Utilite' No. 7411108 discloses a barrel-shaped plastics moulding, whose body is made in two halves sealed together along their edges. A separate top is secured to the body and has a narrow neck for receiving a stopper. The neck has inwardly extending projections which receive trunnions of a handle. This is a complicated construction, which could not be made in one piece by injection moulding and has no relation to the type of container with which the invention is concerned. It would not be obvious to a skilled person faced with the problem solved by the present invention, to injection mould the container with inward projections in the body side wall, if this French publication was available to him. The problem is not relevant to this publication and adaption of a container of the type for holding paint to the construction shown in this publication would render the container useless for its intended purposes, as well as making it impossible to produce by injection moulding.

Furthermore, it would be impossible to make a container of the type envisaged by the present invention by blow-moulding. In addition, blow-moulding produces a container with walls of uneven thickness, so that very thick walls would be required for a container of sufficient strength, as compared with the very thin and strong walls which can be achieved by injection moulding in polypropylene. The external finish of a blow-moulded container is also poor and the smooth printed finish attainable by the present invention is not attainable by blow-moulding techniques.

In the preferred construction, pivotal movement is facilitated by the provision of spaced annular ribs on a spigot of the handle, which ribs define bearings journalled in the recess. This ensures that the handle cannot bind and be held in a raised position, which would interfere with automatic handling of the containers, e.g. during filling. One of these ribs co-operates with a shoulder at the entrance to the recess to retain the handle in the recess. The arrangement is such that the spigots can automatically be pushed into the recesses to provide the pivotal inter-connections, the shoulder and/or the ribs being resilient to provide for snap-engagement.

The spigot is pivotally movable relative to the body of the container and this could cause a problem in mechanical handling for filling the container. There is some vibration during conveyance and the handles could move into positions where they interfere with the process. This is prevented by providing the end of each spigot and the adjacent end wall of the respective recess with resiliently interengageable parts, which define location means for resiliently holding the handle in a given position. The handle may be held positively in a precise position, or resiliently prevented from passing a precise position until a small force is applied to the handle.

Reference is now made to the accompanying drawings, wherein.

Figure 1:
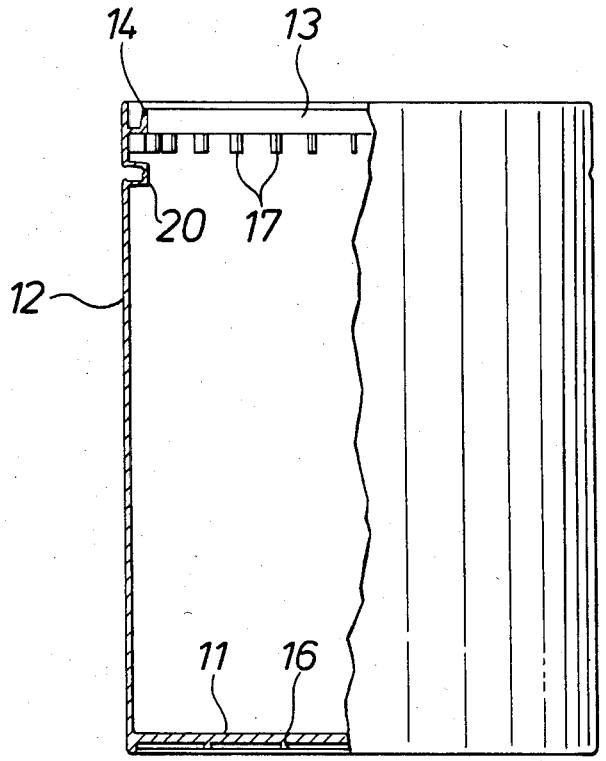
FIG. 1 is a side elevation of a body of a container according to the invention, shown partly in cross-section.

The container shown in FIG. 1 is a one-piece injection moulding and has a bottom 11, a main cylindrical wall 12 and an open mouth 13 surrounded by an inwardly extending peripheral rim 14, formed as a drip channel.

Figure 2:
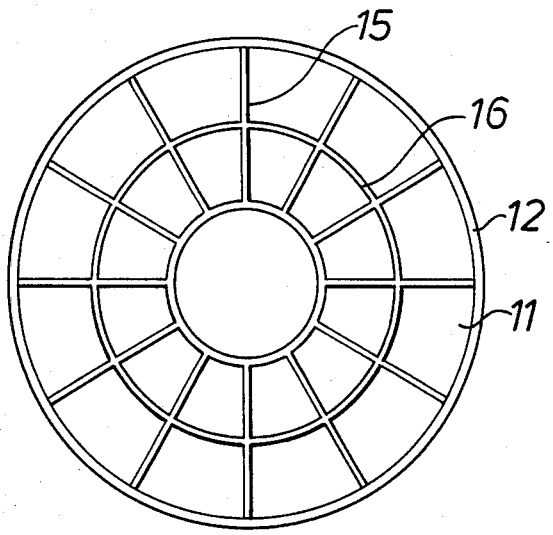
FIG. 2 is an underneath plan view of the container body.

As shown in FIG. 2 the bottom 11 is reinforced by a pattern of integral radial and circular ribs 15, 16.

The cylindrical wall 12 is provided internally with integral vanes 17 adjacent the rim 14, the vanes being spaced around the wall.

Figure 3:
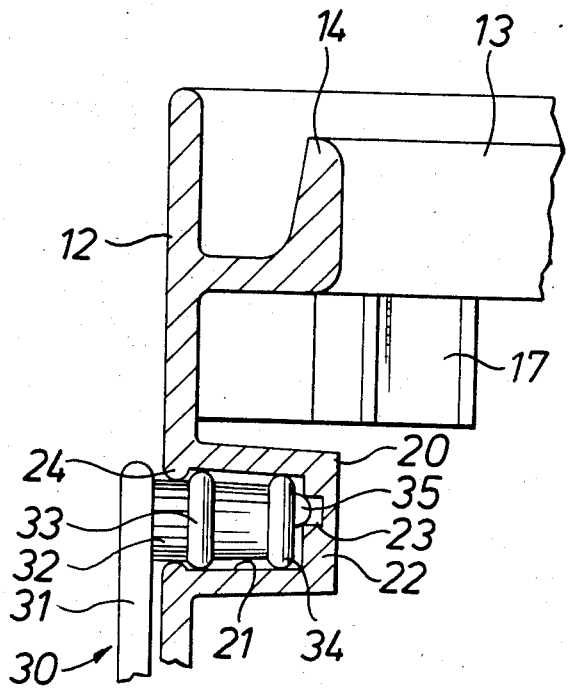
FIG. 3 is an enlarged detail view in cross-section showing how a handle is attached to the body of the container.
Figure 4:
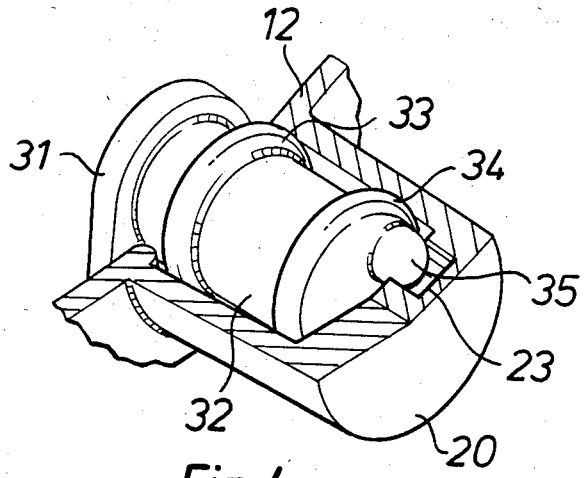
FIG. 4 is an enlarged perspective view, partly in section, of a detail of the container showing a connection of the handle to the body.

Below the vanes, two diametrically opposite bosses 20 are provided projecting inwardly of the body. As shown in FIGS. 3 and 4, each boss 20 is hollow, defining a recess 21 open to the exterior of the body, but closed to the interior of the body by an end wall 22. At the inner end of the recess, a shallow depression 23 is provided in the end wall 22. The mouth of the recess is constricted by an annular rim 24 whose surface is radiussed in cross-section.

The container includes a carrying handle 30, only part of which is illustrated in FIGS. 3 and 4. The handle is also moulded and is of the yoke type, conventional in paint cans, in which the handle is generally of inverted U-shape and bridges the mouth of the can in the carrying position, the free end of each leg of the U being pivotally mounted on the cylindrical wall of the can.

In FIG. 3, the end part of one leg 31 of the handle 30 is shown, and this carries a spigot 32 extending axially perpendicularly to the length of the leg 31. The other leg of the handle (not shown) is similarly formed, with the two spigots lying on a common axis and extending towards each other. Each spigot engages in a corresponding one of the recesses 21.

Each spigot 32 is provided with a pair (or more) of axially spaced peripheral ribs 33, 34, each of which is radiussed in cross-section. These ribs engage and slide on the internal peripheral wall of the respective recess 21 to facilitate pivotal movement of the spigots in the recesses.

Each annular rim 24 similarly slidably engages with the external surface of the respective spigot and serves to retain the spigot in the recess by co-operation with one of the peripheral ribs 33. The material of the main wall and/or the handle is sufficiently resilient to allow for snap-engagement of each spigot in its recess.

On the free end wall of each spigot is a detent 35, which is engageable with the depression 23 in the end wall 22 of the recess. This locates the handle relative to the body in a given position and resiliently resists movement from that position. This prevents the handle from being moved by vibration during conveyance of the containers for filling and fitting of lids.

The vanes 17 prevent swirling of liquid in the container, during handling, and thereby prevent spillage.

Before fitting of the handle, the cylindrical wall of the container has a smooth exterior, with no projections, which can easily be printed.

The handle 30 may comprise a resiliently flexible length of material having the spigots 32 formed on each end, the flexibility allowing for bending of the spigot ends relative to the adjacent parts of the handle, instead of the spigots being formed perpendicularly to the adjacent parts of the handle.

I claim:

1. A container comprising:

(a) a body formed as a single injection moulding including as parts of said moulding a cylindrical wall, a rim, a pair of bosses and retaining means associated with said bosses, said cylindrical wall having a bottom closing one end of the cylindrical wall, said rim being adjacent the opposite end of the cylindrical wall and projecting radially inwardly and defining a mouth, the rim being adapted to receive a plug-fitting lid to close the mouth, said pair of cylindrical bosses being located at diametrically opposite sides of the cylindrical wall and axially spaced from said rim, said bosses projecting from an internal surface of the cylindrical wall towards each other, each boss having a socket defined by an inner cylindrical surface having an opening at the external surface of the cylindrical wall and closed at the opposing end, said retaining means being offset with respect to said inner cylindrical surface, and (b) a handle mountable in yoke fashion on the body, the handle comprising a strap and a pair of spigots, one at each end of the strap, each spigot having a peripheral surface rotatably engagable with said inner cylindrical surface of a respective one of said bosses and having means engagable with the retaining means associated with said bosses, whereby the handle is rotatably retained on the body.

2. A container according to claim 1, wherein each spigot has a plurality of radially outwardly projecting annular ribs spaced axially along the spigot, the ribs defining rotary bearings journalled in the respective socket and one of said annular ribs defining said outward projection.

3. A container according to claim 2, wherein each inward socket projection is defined by an annular flange.

4. A container according to claim 1, wherein at least one spigot and its corresponding socket are provided with resiliently co-operable parts defining resilient stop means which locate the handle in a given position relative to the body, the handle being movable to rotate the spigots to overcome the resilience of the stop means.

5. A container according to claim 4, wherein the axial inner end of said spigot is provided with one of said co-operabe parts, the other of said parts being provided on the bottom wal of the socket.

6. A container according to claim 1, wherein the rim comprises a radially extending flange and an axially extending flange carried by the radially extending flange and defining an annular channel with the cylindrical wall.

7. A container according to claim 1, wherein the bottom is located within the cylindrical wall to define a shallow recess, and wherein the container further comprises reinforcing ribs integrally moulded with the body in said recess at least some of said ribs being joined to both said bottom and said cylindrical wall.

* * * * *